United States Patent [19]

Gordon et al.

[11] 4,292,898

[45] Oct. 6, 1981

[54] FILAMENT COMPOSITE RAILROAD CAR

[75] Inventors: Robert Gordon, Arcadia; Harry A. King, Yorba Linda, both of Calif.; James V. Springrose, Edina; Robert W. Cuddihy, Fridley, both of Minn.

[73] Assignees: Cargill, Incorporated, Minneapolis, Minn.; Structural Composite Industries, Inc., Azusa, Calif.

[21] Appl. No.: 113,240

[22] Filed: Jan. 18, 1980

Related U.S. Application Data

[63] Continuation of Ser. No. 864,243, Dec. 27, 1977, abandoned.

[51] Int. Cl.[3] ..... B61D 7/00

[52] U.S. Cl. ..... 105/238 R; 105/358; 105/248; 528/299

[58] Field of Search ..... 105/358, 360, 238; 528/299

[56] References Cited

U.S. PATENT DOCUMENTS

| | | | |
|---|---|---|---|
| 2,980,972 | 4/1961 | Kloote et al. | 105/360 |
| 3,139,841 | 7/1964 | Krause, Jr. | 105/360 |
| 3,495,548 | 2/1979 | Rollins | 105/358 |
| 3,577,932 | 5/1971 | Rollins | 105/358 X |
| 3,687,087 | 8/1972 | Yurkoski et al. | 105/248 X |

OTHER PUBLICATIONS

Morgan, Phillip, Glass Reinforced Plastics, Iliffe Books Ltd. N.Y. 1961 pp. 230–231 and 254–258.

Modern Plastics Encyclopedia Issue for 1964, vol. 41/No. 1A, Sep. 1963, pp. 522–524.

*Primary Examiner*—Leslie J. Paperner
*Assistant Examiner*—L. E. Williams
*Attorney, Agent, or Firm*—Fitch, Even, Tabin, Flannery & Welsh

[57] ABSTRACT

A filament wound railroad car including an elongated, load bearing body having walls formed of a specified fiber reinforced plastic resin composite of glass reinforcing filaments and a structural organopolymeric resin having particular characteristics.

3 Claims, 14 Drawing Figures

47
47
38
34
36
45
48
47
6
6
7
7
50
8
8
51
42
46
44

47
45
48
44
44
45
47
34
36
32
50
52
54
32
54
50
52

54
52
50
56
32
55
51

FILAMENT COMPOSITE RAILROAD CAR

This is a continuation, of application Ser. No. 864,243, filed Dec. 27, 1977, now abandoned.

The present invention is directed to railroad cars, and more particularly is directed to railroad cars having a filament-reinforced, plastic resin car body.

Conventional railroad cars, such as tank and hopper cars, generally include an underframe with one or two sills extending the length of the car for supporting a car body and transmitting longitudinal forces, with the underframe supported near its ends on trucks. The forces, particularly the loading forces to which railroad cars are subjected, are quite substantial. The magnitude of these forces and the repetitive application, removal and relaxation of such forces must be reliably withstood in a serviceable railroad car design.

Railroad tank cars have been made wherein a tank is cradled near its ends in cradle structures mounted on the trucks, as shown in Geyer, et al. U.S. Pat. No. 3,712,250. As there shown, a metallic center sill transmits longitudinal forces. Tanks have been made of fiber glass reinforced plastics, as shown in Anderson, et al. U.S. Pat. No. 3,158,383, and such tanks have been mounted on metallic, load-bearing railroad car underframes of the sort shown in the aforesaid U.S. Pat. No. 3,712,250. It is also known, as shown in Phillips U.S. Pat. No. 3,252,431, to support a car body near its ends by cradling it on short truck-supported sill sections, with the car body reinforced as to be selfsupporting between the sill sections. Steel hopper cars with stub center sills have been made where the car body has been supported on trucks by bolster structures extending upward from the trucks to the underside of respective sloping end plates with massive stiffening members for resisting the bending of such end plates by the substantial transverse forces supporting the car body.

Railroad cars of the prior art have included heavy supporting structures and/or heavy structural elements that have required a substantial portion of the gross weight of a loaded car to be the weight of the car itself. These heavy structural elements have generally included longitudinal metallic structural elements to transmit and withstand the substantial longitudinal forces exerted on the car during service. Because the gross weight of a railroad car is limited by regulations, any reduction in the weight of the car itself while maintaining structural integrity is desirable because it permits a larger payload and hence more economical operation. In the United States, to be eligible for interchange between railroads, the cars must meet the specifications for acceptability of the Association of American Railroads, including such weight limitations.

In accordance with the present invention, the car is made lighter than conventional cars by providing a relatively lightweight car body which is also adapted to serve as a load-bearing member for all loads. The car body is made of glass filaments embedded in a specific structural resin matrix having a particular combination of properties.

It is thus a primary object of the present invention to provide a lightweight railroad car. It is another object of the invention to provide such a car having a load-bearing car body with walls formed of a filament-reinforced resin matrix.

Other objects and advantages will be apparent from a consideration of the following detailed description, particularly when taken in conjunction with the accompanying drawings of which:

FIG. 4 is a vertical section of a portion of the car body of the railroad car shown in FIG. 1 taken along the center line of the car, with a portion shown in elevation;

Figure 2:
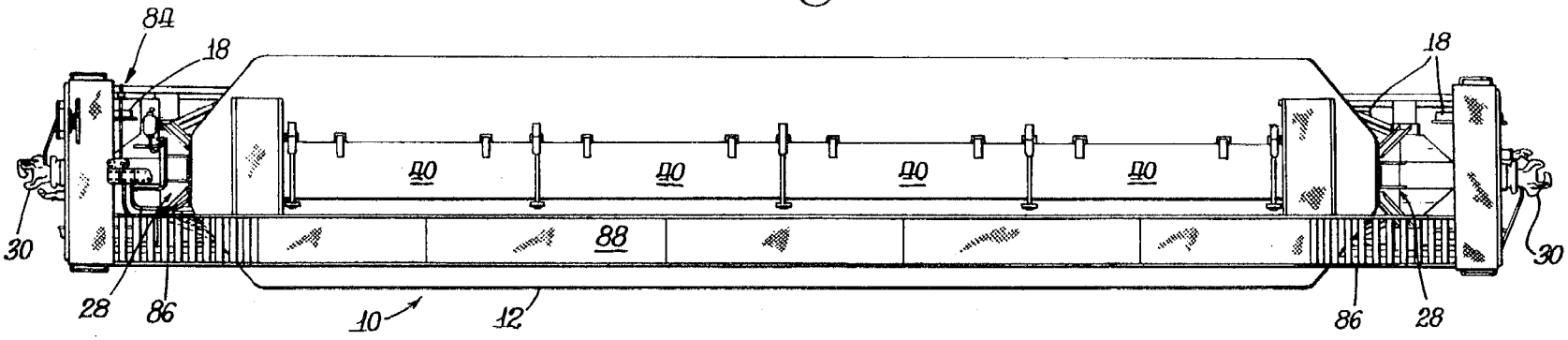
FIG. 2 is a plan view of the railroad car shown in FIG. 1.

Generally, the present invention is directed to a railroad car comprising an elongated, load-bearing car body having walls formed of a particular filamentl-reinforced, resin composite.

The filament-reinforced organopolymeric resin walls of the car body comprise from about 60 to about 75 weight percent of glass reinforcing filaments, and from about 25 to about 40 weight percent of a specified structural organopolymeric matrix resin, based on the weight of the filament-reinforced resin matrix composite. The railroad car includes coupling means at each end of the car for coupling the car to other cars, a truck at each end of the car body, and supporting means pivotally mounted on each of said trucks for supporting said car body on said trucks for transport on rails.

The organopolymeric matrix resin of the composite is an important aspect of the railroad car of the present invention. The resin must transfer applied stresses between the glass filaments without cracking under severe loading and longitudinal stress conditions such as those encountered in traction, braking, coupling, and humping operations. Furthermore, the resin matrix must protect the glass filaments of the composite from the environment and impact under conditions of use, at temperatures ranging from about 165° F. down to about −65° F., must withstand the repeated loading and unloading cycles encountered during the service life of the railroad car, and retain the car shape.

The heat deflection temperature and the tensile elongation property of the matrix resin composition are two primary properties in the provision of structural composites adapted for use in the wall of the railroad car of the present invention. In this regard, the matrix resin should have a combination of properties which includes a relatively high heat deflection temperature together with a relatively high tensile elongation. This combination of relatively high heat distortion temperature and tensile elongation is difficult to obtain and presents conflicting demands upon the resin composition because heat distortion is related to resin rigidity and the percent elongation is related to resin resiliency. Furthermore, the matrix resin employed in the present invention should also have at least the hardness, strength, and modulus properties equal to or greater than certain specified values. In connection with all of these properties, the matrix resin for the filament-reinforced composite of the car body walls of the present invention is defined in accordance with the following specifications:

CURED RESIN PROPERTIES

| Property | Test Method | Value |
|---|---|---|
| Barcol Hardness | ASTM D-2583-72 | at least 40 |
| Heat Distortion Temperature | ASTM D-648-72 (264 psi. stress) | at least 90° C. |
| Flexural Strength* | ASTM D-790-71 | at least 20,000 psi. |
| Flexural Modulus* | ASTM D-790-71 | at least $5.0 \times 10^5$ psi. |
| Tensile Strength* | ASTM D-638-72 | at least 10,000 psi. |
| Tensile Modulus* | ASTM D-638-72 | at least $5.0 \times 10^5$ psi. |
| Tensile Elongation* | ASTM D-638-72 | at least 3.0 percent |

*⅛" clear casting tested at room temperature, 24 hours after cure at 70° C. for 2 hours, following by 121° C. for 2 hours.

Unless otherwise indicated, the tests referred to herein should be carried out at ASTM specified standard conditions of temperature (25° C.), and relative humidity (50 percent RH).

As indicated hereinabove, the composite walls comprise from about 60 to about 75 weight percent, and preferably from about 63 to about 67 percent, of the weight of the reinforced composite of glass reinforcing filaments embedded in the matrix resin. The filaments may be composed of conventional filament E-type glass, which is generally a low alkali, lime-alumina, borosilicate glass. The glass filaments will generally have a diameter of less than about 1.0 mil, and preferably from about 0.6 mil to about 0.9 mil. Strands or rovings made up of these filaments having a relatively low yield, such as less than about 225 yards per pounds, may be preferred in production in order to limit the number of roving balls used at one time.

In accordance with conventional reinforced resin composite practice, the composite system should be provided with a coupling agent for improving the resin-glass interface adhesion. Silane coupling agents which have, or are capable of providing, resin reactive capability and silanol-glass surface interaction are well known and are particularly adapted for this function. The glass fibers may be advantageously sized with such coupling agents in order to provide the coupling agent in the composite system. From a practical standpoint a helical winding pattern is preferred in which the filaments are oppositionally oriented in the matrix in a helical pattern at an angle of less than 30° from the longitudinal axis of the car body to achieve greater strength in the longitudinal direction by preferentially orienting the filaments in the direction of the applied forces. A helical winding angle of about 20° to the longitudinal axis in a helical winding pattern is advantageously employed in longitudinal load-bearing railroad car bodies of the present invention in which longitudinal strength approximately 80 percent of the maximum strength obtained when all filaments are longitudinal is provided, while also providing a significant reinforcement component in a direction orthogonal to the longitudinal axis. A "polar" winding pattern, in which filaments are oriented parallel to the longitudinal axis of the car, may be more structurally efficient and may permit even lighter weight construction (e.g., in the range of 5–10 percent lighter) through tailoring of winding thickness distribution, i.e., more windings at the top and bottom of the car body than at the sides. The polar winding pattern requires provision for windings, such as hoop windings, having a directional component orthogonal to the polar windings. Such hoop windings may also be employed in conjunction with a helically-wound filament configuration in order to provide additional circumferential strength to the car body.

The glass filament resin-composite system employed in the car body of the present invention should meet certain minimum properties which may be defined in terms of a composite system of the resin in which the glass filaments are uniaxially oriented, even though the composite walls of the car body may not contain uniaxially oriented filaments. In general, in plane or "polar" windings without hoop winding would be considered uniaxial composites, while helical windings would not be considered uniaxial composites. The resin-glass system employed in the present invention should be capable of providing uniaxial composite parameters in accordance with the following combination of specifications:

UNIAXIAL COMPOSITE PROPERTIES

| Property | Test Method | Specified Value |
|---|---|---|
| Tensile Strength | ASTM C2290-69 and D2291-67 | at least 100,000 psi |
| Interlaminar Shear Strength | ASTM D2344-72 | at least 5,000 psi |
| Flexural Strength | ASTM D790-71 Method II - (Modified) | at least 100,000 psi |
| Flexural Modulus | ASTM D790-71 Method II - (Modified) | at least $6 \times 10^6$ psi |
| Flexural Fatigue Strength for $1 \times 10^6$ Cycles | ASTM D790-71 Method II - (Modified) and D2992-71 - (Modified) | at least 30,000 psi |
| Density | ASTM D792-66 | at least .07, preferably from .07 to .08 lb./in.$^3$ |
| Glass Content By Weight | ASTM D2584-68 | at least 70, and preferably from 70 to 80 percent |

Because the reinforced composite should exhibit structural properties over a wide range of environmental conditions, such a uniaxial composite should also best meet or exceed certain performance parameters when tested 165° F. or after being subjected to boiling water, as follows:

| Property | Test Method | Specified Value |
|---|---|---|
| Tensile Strength at 165° F. | ASTM D-2291-69 and D-2291-67 | at least 100,000 psi |
| Tensile Modulus at 165° F. | ASTM D-2290-69 and D-2291-67 | at least $6 \times 10^6$ psi |
| Interlaminar Shear Strength After 24 Hour Water Boil | ASTM D-2344-72 | at least 5,000 psi |
| Flexural Strength at Room Temperature | ASTM D-790-71 Method II (Modified) | at least 100,000 psi |
| Flexural Modulus at Room Temperature | ASTM D-790-71 Method II (Modified) | at least $6 \times 10^6$ psi |

As indicated, the resin-glass filament system should be capable of providing these values when used in a uniaxial composite test specimen whether or not the filaments are uniaxially oriented in the car body walls.

As also indicated, it is preferred that the car body walls be helically wound at an angle of less than 30° and preferably at an angle of about 20° to the longitudinal axis of the car body. In this regard, properties are specified for composites in which alternating layers of filaments are aligned, respectively, at an angle of +20° and −20° with respect to the longitudinal axis of the composite. As in the case of the uniaxial composite properties, the resin-glass filament system should be capable of meeting the following combination of 20° oppositionally oriented filament composite specifications, whether or not a 20° helical winding pattern is used in the winding of the car body:

±20° Fiber Orientation Properties at Room Temperature Along the Axial Direction

| Property | Test Method | Specified Value |
|---|---|---|
| Tensile Strength | ASTM D638-72 (Modified) | at least 80,000 psi |
| Compressive Strength | ASTM D695-69 (Modified) | at least 80,000 psi |
| Longitudinal Shear Strength | Fed. Specification LP 406 Method 1401 (rectangular punch) | at least 5,000 psi |
| Flexural Strength | ASTM D790-71 Method II (Modified) | at least 80,000 psi |
| Flexural Modulus | ASTM D790-71 Method II (Modified) | at least $4.3 \times 10^6$ psi |
| Bearing Strength | ASTM D953-54 (Modified) | at least 25,000 psi |
| Glass Content by Weight | ASTM D2584 | at least 60, and preferably from 60 to 70 percent |
| Density | ASTM D742-66 | at least .06 and preferably from .06 to .07 lb./in.$^3$ |
| Flammability Rating | Fed. Test Method STD. No. 406 Method 2021 | "Self Extinguishing by this Test" |

Figures 10, 11, 12, 13, 14:
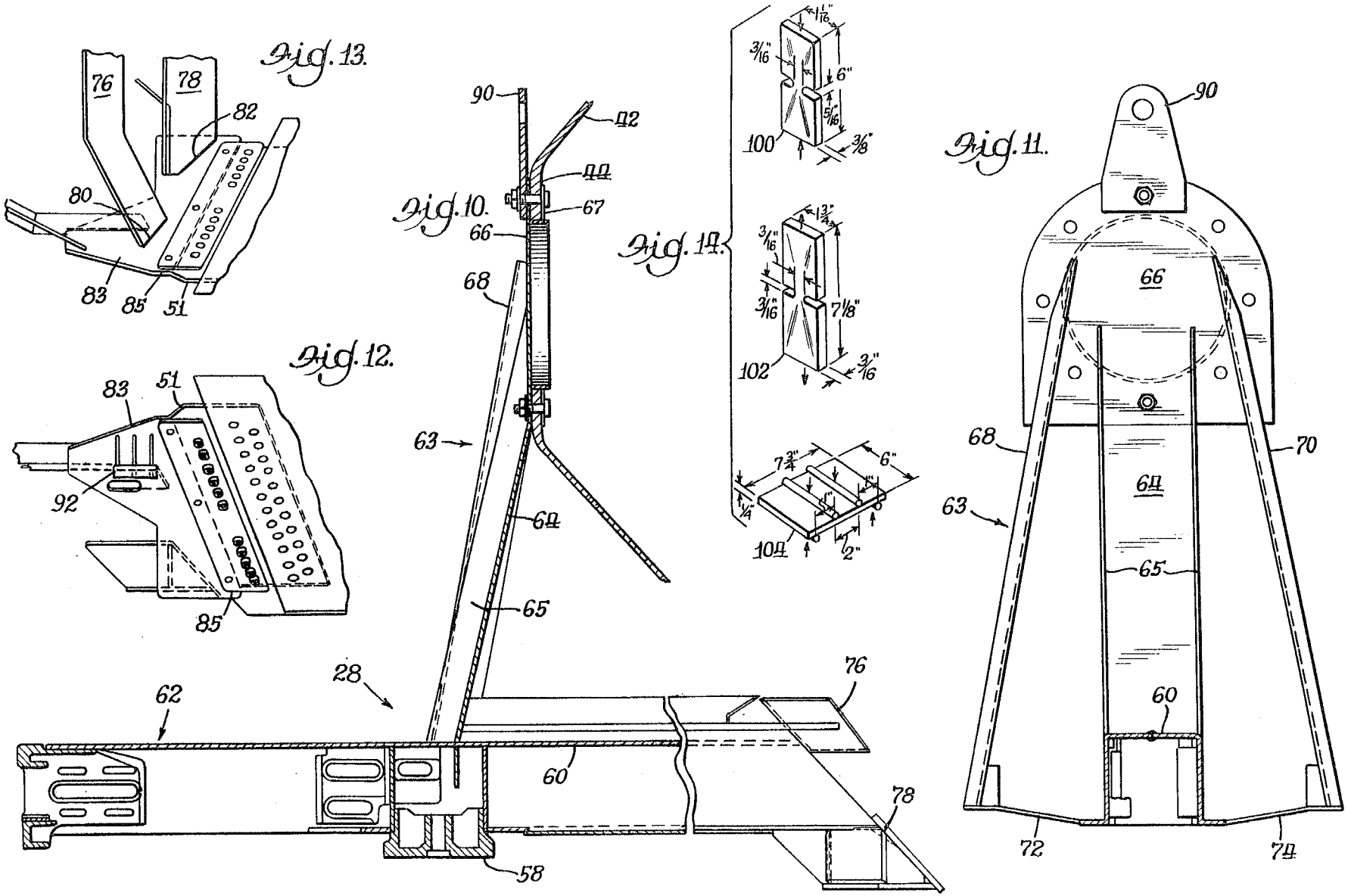
FIG. 10 is a vertical sectional view of the supporting structure shown in FIG. 9, taken along line 10—10 of FIG. 9; and also showing the connection thereof to the end wall of the car body.
FIG. 11 is a vertical end view of the vertical supports of the supporting structure shown in FIG. 8, with the center sill of the supporting structure shown in section.
FIG. 12 is a side elevation of part of one side of the supporting structure shown in FIG. 9, showing the connection to the end of the beam column shown in FIG. 8.
FIG. 13 is a plan view of the structure shown in FIG. 12.
FIG. 14 is a representation of some of the various test specimens useful for characterizing filament-resin composite systems.

As indicated in the preceding table, various of the herein-indentified ASTM test methods employ test specimens having a slightly different shape than the standard ASTM test specimen, but otherwide are the same as the indicated ASTM testing procedure. Standard test specimens, such as a tensile "dog bone" specimen in accordance with ASTM specification D638-72, tend not to give proper strength values for continuous filament-reinforced composite materials, for example, because filaments may be cut in machining the specimens along each side of the gauge section of the specimen, resulting in tests of short, cut filaments which are not representative of the continuous filament-reinforced composite of the car body. The shapes and dimensions of substantially modified test specimens are shown to scale in FIG. 14, and the tests which employ a modified test specimen are so indicated. Specimen 100 of FIG. 14 is the modified specimen for compression testing and is used instead of a test specimen defined by ASTM B695-69. Specimen 102 is the modified tension test specimen which is used instead of the ASTM D638-72 specimen. Specimen 104 is the modified flexural specimen which is used instead of the ASTM D790-71 specimen in the modified tests (flexural strength, flexural modulus, and flexural fatigue tests). The longitudinal shear strength test of Federal Specification LP406, Method 1401, employs a rectangular punch and a test specimen with filament orientation such that the filaments are parallel to the applied force. The flexural strength test of D790-71 may be further modified by using the regression analysis procedure of D2992-71, as indicated in the table, as another referred to modification. The bearing specimen may be desirably provided with a slight curvature in the plane of the specimen because such specimens are desirably made by winding against a slightly convex surface rather than a flat surface.

The present invention will now be further described with reference to the specific embodiment of the railroad hopper car illustrated in the drawings.

Figure 1:
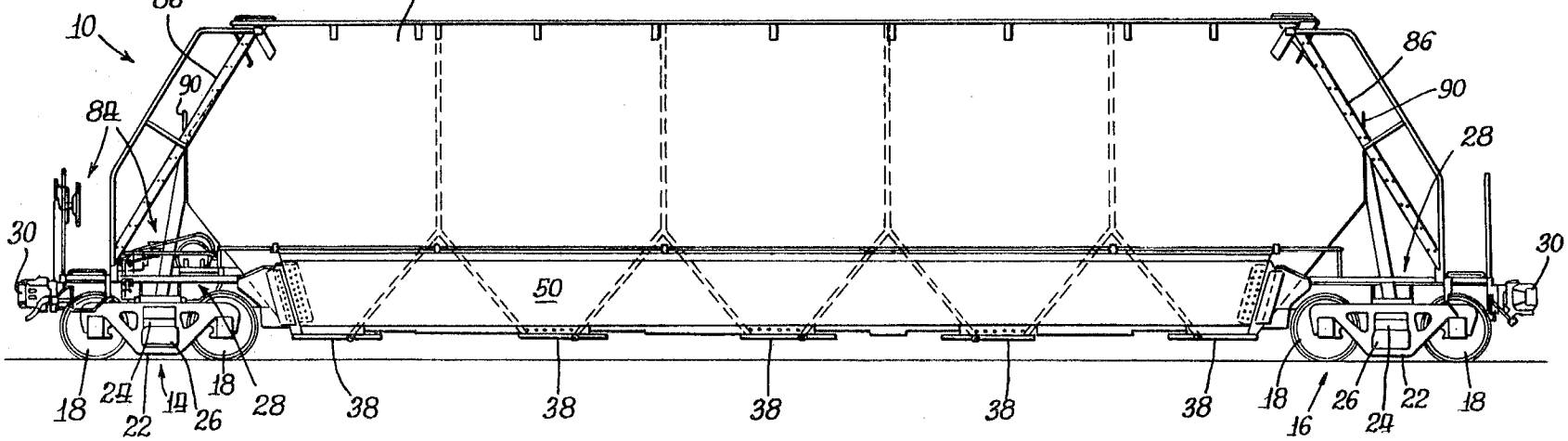
FIG. 1 is a side elevation of one form of railroad car of the present invention.
Figure 5:
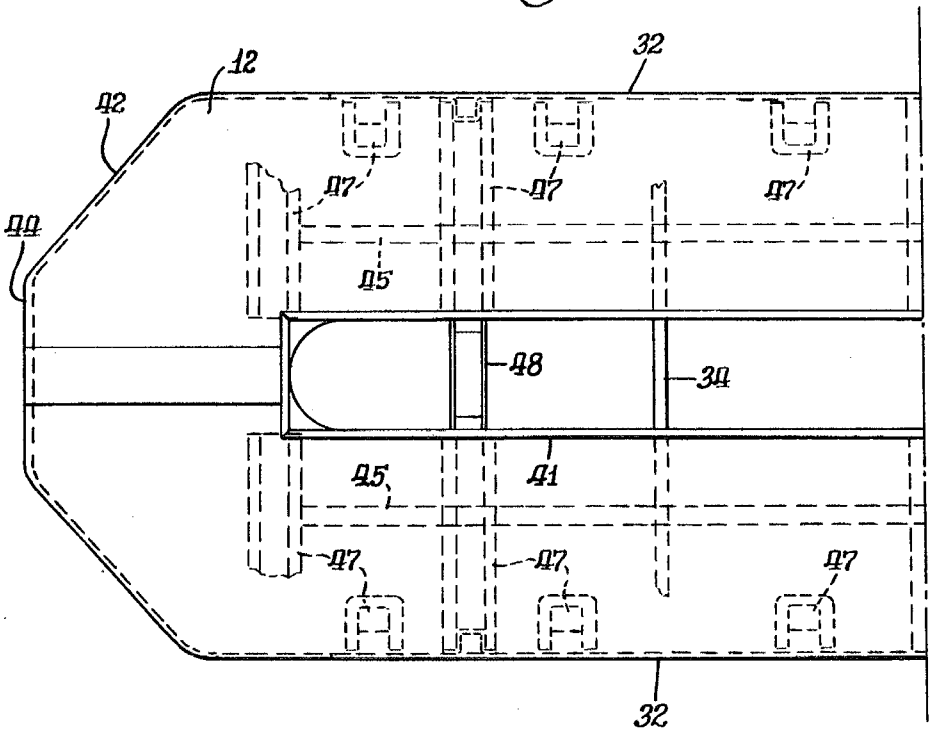
FIG. 5 is a plan view of a corresponding portion of the car body of the railroad car shown in FIG. 1.
Figure 3:
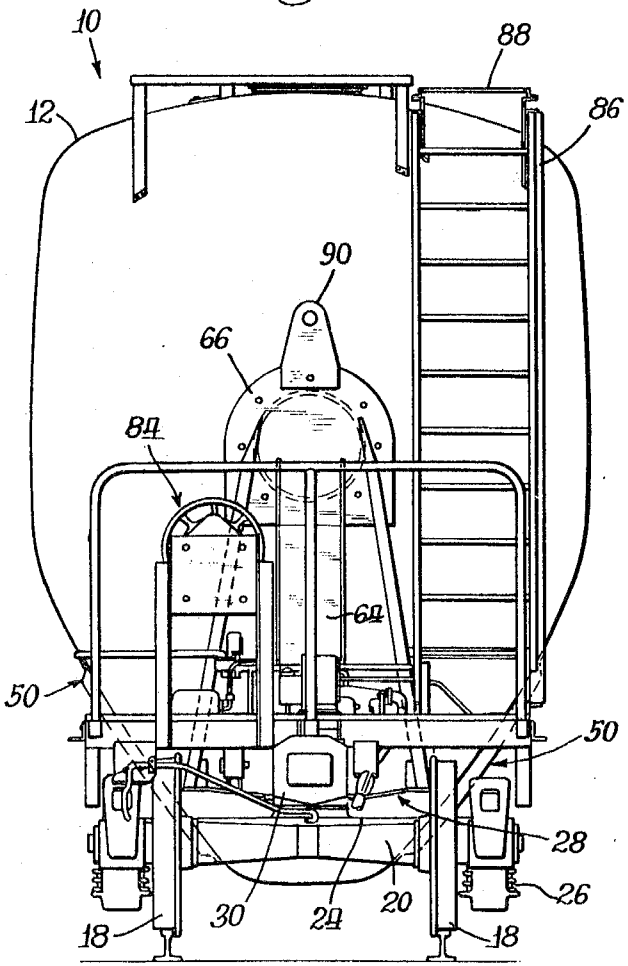
FIG. 3 is an end view of the railroad car shown in FIG. 1.

As shown in FIGS. 1, 2 and 3, a railroad hopper car 10 comprises a car body 12 supported at its ends by trucks 14 and 16. The trucks 14 and 16 may be conventional railroad car design for rolling on rails. The trucks 14 and 16 may, as shown, include wheels 18, joined by axles 20, on which are supported truck side frames 22. Truck bolsters 24 are resiliently supported on the truck side frames 22 by springs 26. A supporting structure 28 is rotatably mounted on each truck bolster. Such supporting structure is connected to a respective coupler 30 at each end of the car for coupling to other cars, including a locomotive.

Figure 7:
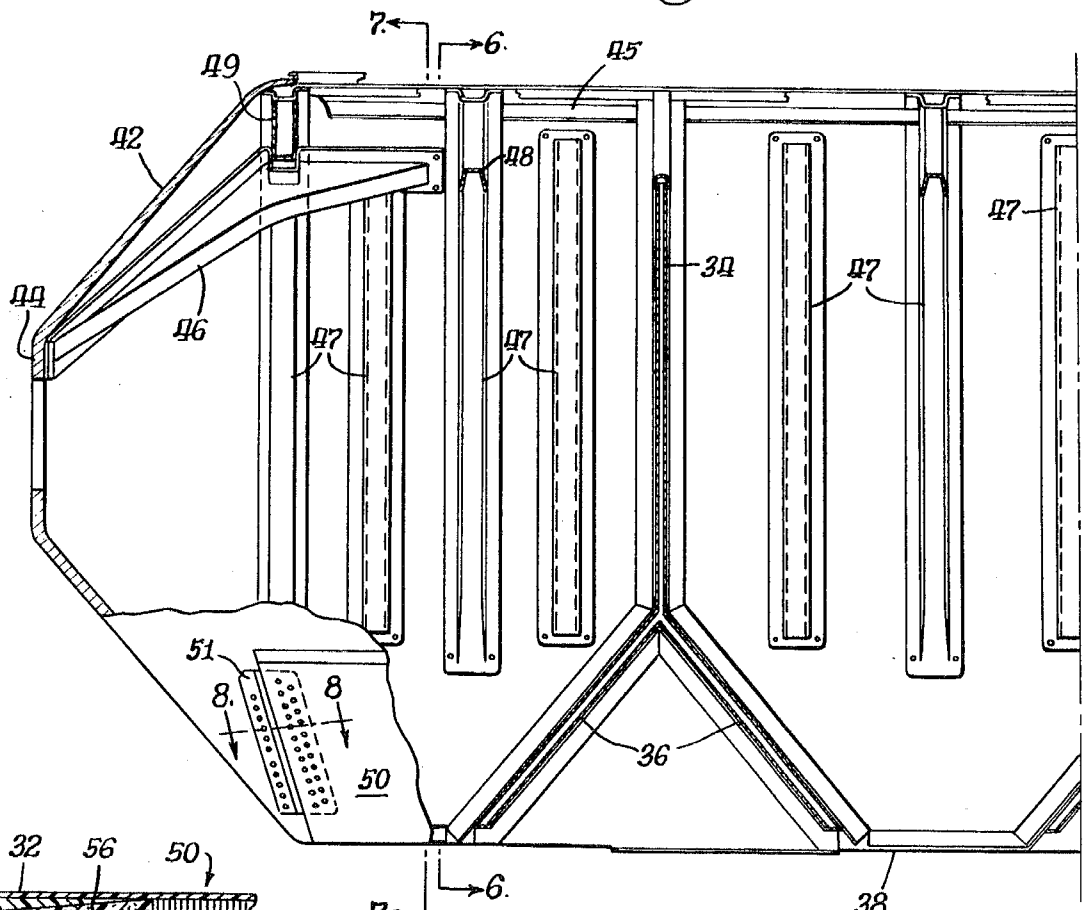
FIG. 7 is a vertical sectional view of the car body shown in FIG. 4, taken along line 7—7 of FIG. 4.
Figure 6:
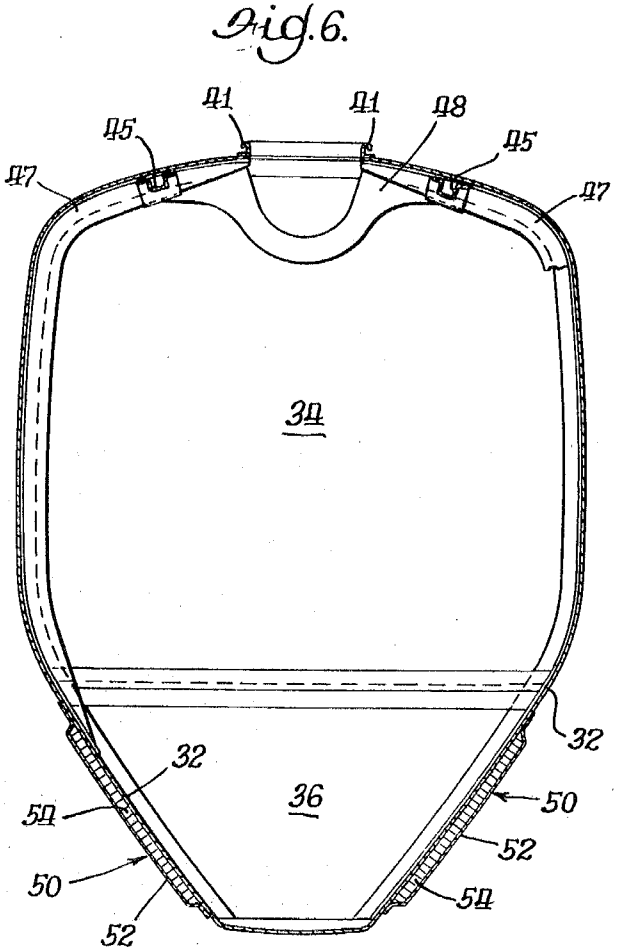
FIG. 6 is a vertical sectional view of the car body shown in FIG. 4, taken along line 6—6 of FIG. 4.

As shown in greater detail in FIGS. 4, 5, 6 and 7, the illustrated car body 12 is generally cylindrical in the broad sense that it has a generally uniform cross section, as shown in FIGS. 6 and 7, with the filament-reinforced organopolymeric matrix composite walls 32 extending longitudinally of the car. The illustrated car body is formed as a hoppertype car body which is particularly adapted for carrying grain, with sloping sides near the bottom at a slop angle of about 50° to the horizon in order to facilitate the removal of the contents of the car. To obtain a relatively large cross section within standard railroad car limits as provided by regulation, the side walls 32 are relatively vertical and the top is relatively horizontal. At the same time, there are no sharp angles, the entire car being formed by winding filaments on a mandrel having curved surfaces. The car body is divided into separate hopper sections by bulk heads 34 which extend down to slope sheets 36 which form the lower portions of the hopper sections and are also sloped at an angle of about 50° to the horizontal to facilitate removal of the contents of the hopper sections. Hopper gates 38 provide means for opening the hopper sections for removal of the contents in a conventional manner. The tops of the various hopper sections are covered by hatch covers 40 mounted on hatch rails 41. The hatch covers 40 may be opened to permit falling of the respective hopper sections. At each end of the car is a substantially conical end wall 42 formed integrally with the longitudinally walls 32 and extending from the ends of the longitudinal walls to the truncations 44 of the end walls 42, where the supporting structures 28 are connected to the car body 12. The slope of these walls at the bottom is about 50° to the horizontal. The walls are substantially conical in the broad sense that their surfaces are substantially traced by a straight line passing through a respective vertex, whereby vertical forces at the truncations produce forces transmitted along substantially straight lines to the ends of the longitudinal walls. A circular cone with its vertex near the centroid of the longitudinal walls has been found particularly advantageous as it provides a shape convenient for filament winding.

The hopper car body illustrated is made by helically winding continuous filaments on a mandrel, with the filaments extending along and around the conical ends to the truncations. In this connection, a number of glass filaments are gathered into strands or rovings. The strands or rovings are fed from spools to form a flat band which is fed through a bath of liquid polyester resin and applied to the mandrel with appropriate pretensioning to provide a minimum of "relaxed" filaments. The nominal minimum wall thickness of the illustrated embodiment is about ¼". The glass filaments in the illustrated embodiment are typically from about 0.6 to 0.9 mils thick and are composed of E-glass such as the FIBERGLAS 431AA225, Type 30, continuous roving product of Owens Corning Fiberglas Corporation. The glass filaments are provided with a type 431 silane coupling agent sizing of Owens Corning which is adapted to provide interface adhesion between the glass filaments and the cured polyester resin matrix. The filament band, which may be perhaps a foot in width, is laid down at an angle of about 20° to the longitudinal direction of the car body. The helical winding pattern results in filaments being oppositionally laid down, with filaments applied in one longitudinal direction crossing those laid in the opposite direction, both being at about 20° from longitudinal and hence at about 40° to each other. The winding is programmed to cover the mandrel completely. Several layers are laid in each direction to build up a wall thickness of about one-fourth inch. Because of the smaller diameters at the truncations 44, the filament layers overlap more there, providing thicker and hence stronger sections for connection to the supporting structures 28. Additional structural reinforcements may be applied to local regions of the composite wall for additional strength and modulus enhancement. These reinforcements may be filament wound or woven from rovings similar to those used in the base composite.

As indicated hereinabove, the resin matrix used in the illustrated hopper car must be capable of meeting a combination of certain previously described specifications. In the illustrated embodiment, the resin matrix is formed from an unsaturated polyester-styrene system bearing the experimental designation 1023-29 of Cargill Incorporated. The 1023-29 polyester resin is a structural material of the following composition:

| | Percent by weight of Reactor Charge |
|---|---|
| Isophthalic Acid | 16.17 |
| Fumaric Acid | 22.10 |
| Adipic Acid | 12.39 |
| Tetrachlorophthalic Anhydride | 14.56 |
| Propylene Glycol | 34.78 |
| | 100.00 |

Styrene Monomer - Added to Plastic Resin to yield a 63 percent by weight non-volatiles solution The method of manufacture is a 2-stage standard unsaturated polyester polycondensation reaction. The isophthalic acid and propylene glycol are charged to the reactor. The acid and glycol are heated to approximately 210° C. until an acid value of less than 5 is reached. The resulting liquid is cooled to about 135°–140° C., and the fumaric acid, adipic acid, and tetrachlorophthalic anhydride are then charged to the reactor for the second stage of the condensation reaction in which the components are heated to about 210° C. and until an acid value of about 15–20 is obtained. The resulting polyester plastic is cooled to about 160° C. and thinned with the required amount of inhibited styrene monomer to yield a prepolymer resin solution containing about 63 percent by weight of the non-volatile unsaturated polyester resin component. The prepolymer resin solution is applied to the rovings and cured (e.g., by means of an appropriate free radical producing curing agent or catalyst) on the mandrel to form the cured composite structure. The 1023-29 prepolymer resin solution in cured form, has the following typical properties (without filament reinforcement):

CURED RESIN PROPERTIES

| Property | Test Method | Value |
|---|---|---|
| Barcol Hardness | ASTM D-2583-72 | 43–44 |
| Heat Distortion Temperature | ASTM D-648-72 (264 psi stress) | 90° C. |
| Flexural Strength* | ASTM D-790-71 | $21.1 \times 10^3$ psi. |
| Flexural Modulus* | ASTM D-790-71 | $5.32 \times 10^5$ psi. |
| Tensile Strength* | ASTM D-638-72 | $11.14 \times 10^3$ psi. |
| Tensile Modulus) | ASTM D-638-72 | $5.47 \times 10^5$ psi. |
| Tensile Elongation* | ASTM D-638-72 | 3.12 percent |

*⅛" clear casting tested at room temperature, 24 hours after cure at 70° C. for 2 hours, 121° C. for 2 hours.

As previously indicated hereinabove, the resin-filament system should be capable of meeting certain uniaxial and ±20° filament orientation property specifications.

A typical composite of the 1023-29 resin and the Fiberglas 431AA 225 filaments has the following properties in a uniaxial filament orientation:

UNIAXIAL COMPOSITE PROPERTIES

| Property | Test Method | Value |
|---|---|---|
| Tensile Strength | ASTM D2290-69 and D2291-67 | 134,000 psi |
| Compressive Strength | ASTM D695-69 | |
| Interlaminar Shear Strength | ASTM D2344-72 | 8,500 psi |
| Flexural Strength | ASTM D790-71 Method II-(Modified) | 181,000 psi |
| Flexural Modulus | ASTM D790-71 Method II-(Modified) | $7.7 \times 10^6$ psi |
| Flexural Fatigue | ASTM D790-71 | 56,000 psi |

-continued

| UNIAXIAL COMPOSITE PROPERTIES | | |
|---|---|---|
| Property | Test Method | Value |
| Strength for $1 \times 10^6$ Cycles | Method II-(Modified) and D-2992-71 -(Modified) | |
| Density | ASTM D792-66 | .078 lb./in. |
| Glass Content by Weight | ASTM D2584-68 | 80 percent |
| Tensile Strength | ASTM D2290-69 and D2291-67 | |
| at 165° F. | | 105,000 psi |
| at −65° F. | | 164,000 psi |
| Interlaminar Shear Strength After 24-Hour Water Boil | ASTM D2344-72 | $8.3 \times 10^3$ psi |
| Flexural Strength | ASTM D790-71 Method II (Modified) | |
| at Room Temperature | | |
| at 165° F. | | 145,000 psi |
| at −65° F. | | 220,000 psi |
| Flexural Modulus | ASTM D790-71 Method II (Modified) | |
| at Room Temperature | | $6.5 \times 10^6$ psi |
| at 165° F. | | $9 \times 10^6$ psi |
| at −65° F. | | |

The 1023-29 resin and the Fiberglas 431AA 225 filaments have the following typical properties in a ±20° filament orientation test specimen when tested in the axial direction at room temperature:

| ±20° Fiber Orientation Composite Properties | | |
|---|---|---|
| Property | Test Method | Value |
| Tensile Strength | ASTM D638-72 (Modified) | 96,000 psi. |
| Compressive Strength | ASTM D695-69 (Modified) | 80,000 psi. |
| Longitudinal Shear Strength | Federal Specification LP406, Method 1401, (rectangular punch) | 11,000 psi. |
| Flexural Strength | ASTM D790-71 Method II (Modified) | 120,000 psi. |
| Flexural Modulus | ASTM D790-71 Method II (Modified) | $4.2 \times 10^6$ psi. |
| Bearing Strength | ASTM D953-54 (Modified) | 27,000 psi. |
| Glass Content by Weight | ASTM D2584 | 65 percent |
| Density | ASTM D742-66 | .068 lb./in. |
| Flammability Rating | Fed. Test Method STD. No. 406 Method 2021 | "Self Extinguishing by this Test" |

As indicated, various ASTM tests are employed in a modified form which generally involve use of a modified test specimen shape. In this connection, as indicated previously, standard ASTM shape test specimens which are machined along the gauge section of the specimen tend not to provide good results for continuous filament composites.

The modified test specimens employed with the indicated ASTM tests are illustrated in FIG. 14 and are used in order to provide a more accurate measurement of continuously wound filament reinforced composites. The illustrated test specimens are drawn approximately to scale and indicate the major dimensions of the specimen. Arrows illustrate the force vectors involved in testing. In the specimens, uniaxial specimens have fibers aligned with the longitudinal axis of the specimen, and ±20° specimens have layers of fibers alternating at ±20° to the axis. As described previously, specimen 100 is the modified specimen for compression testing, specimen 102 is the modified tension test specimen, and specimen 104 is the modified flexural test specimen.

Although the illustrated embodiment of the railroad car body is specifically described with respect to the Cargill 1023-29 resin and Fiberglass 431AA 225 glass filaments, other filament-resin systems as typically characterized hereinabove may be similarly employed in constructing the railroad car body.

After the filaments are applied to and cured on the mandrel to provide the filament-reinforced resin matrix composite form of the hopper car body, the car body may then be cut in half vertically along the longitudinal center line for removal from the mandrel and insertion of additional structural components such as the bulkheads 34 and slope sheets 36.

The two halves of the car body are then refastened together and to the respective bulkheads 34, slope sheets 36, gates 38, and hatch covers 40. The bulkheads and slope sheets and the mountings for the gates and hatch covers provide stabilization and/or reinforcement for the car body. The bulkheads and slope sheets may each be formed of a pair of sheets formed of woven continuous glass filaments in a resin matrix with the sheets spaced by a lightweight core material, such as conventional honeycomb kraft paper core material for providing bending resistance. Three-inch thick spacers in the bulkheads and two-inch thick spacers in the slope sheets have proved satisfactory. Additional reinforcement is provided by composite ribs 46 extending upwardly and outwardly from the truncation 44 of the respective ends of the longitudinal walls 32 supporting the car body at the small radii of curvature where the roof meets the sides of the body. These aid in supporting the car body and reinforce the end walls 42 against buckling upon loading of the car. Circumferential composite ribs 47 may be used to stabilize the car body in the respective hopper sections. The ribs 47 shorten the unsupported spans and hence increase buckling strength of the top portion of the car body acting as a column in compression. Arcuate crosspieces 48 span the hatch openings to connect certain of the ribs 47 on opposite sides of the car. At the ends straight struts 49 join the end ribs 47. As the ribs 46 extend to the end ribs 47, the struts 49 and end ribs 47 act to reinforce the roof of the car body at the ends against buckling, as may otherwise be occasioned by the lifting forces along the ribs 46. The ribs 46 and 47, the crosspieces 48, and the struts 49 are all preferably made of continuous glass filaments in a resin matrix. Their shapes may be characterized as hat-shaped, so as to form box beams when the bases of the hats are secured to the walls 32 and 42.

The car body 12 is designed to be self-supporting between the supporting structures 28. It is also designed to transmit applied forces to and from the couplers 30. These forces include the sideways forces to turn the car at curves as well as the longitudinal forces for pushing and pulling the car. The most significant forces are generated upon impact, an upon humping the car. Such forces are transmitted longitudinally along the longitudinal walls 32 and are applied endwise to the walls through the action of the supporting structures 28.

The center line of a standard coupler is 34¼ inches from the rails. This provides an unbalanced load at the ends of the longitudinal walls 32, placing a compressive load near the bottom of the walls upon humping. Because the walls are relatively thin, for example, about ¼ inch, beam columns 50 are provided along the bottom of each side of the car. These beam columns 50 terminating in plates 51 are each formed by respective longitudinal members 52 extending the length of the longitudinal walls 32 and spaced therefrom by spacers 54 of a lightweight core material, which may be conventional honeycomb kraft paper cores. The longitudinal members 52, which may be nominally about 3/16 inch thick, may also be formed of continuous glass filaments in a resin matrix. The filaments are preferably woven into fabric with the warp filaments extending in the longitudinal direction of the members. The longitudinal walls 32 and the longitudinal members 52 are adhesively fastened to the spacers 54. The members 52 extend laterally beyond the spacers 54 where they are adhesively fastened directly to the walls 32.

Figure 8:
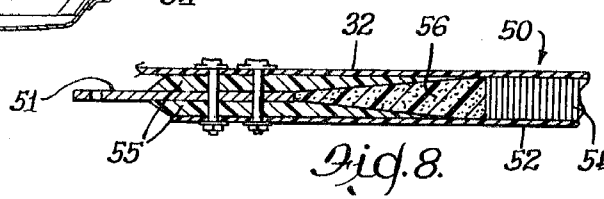
FIG. 8 is a sectional view of the end of a beam column used in the car body shown in FIG. 4, taken in along line 8—8 of FIG. 4.
Figure 9:
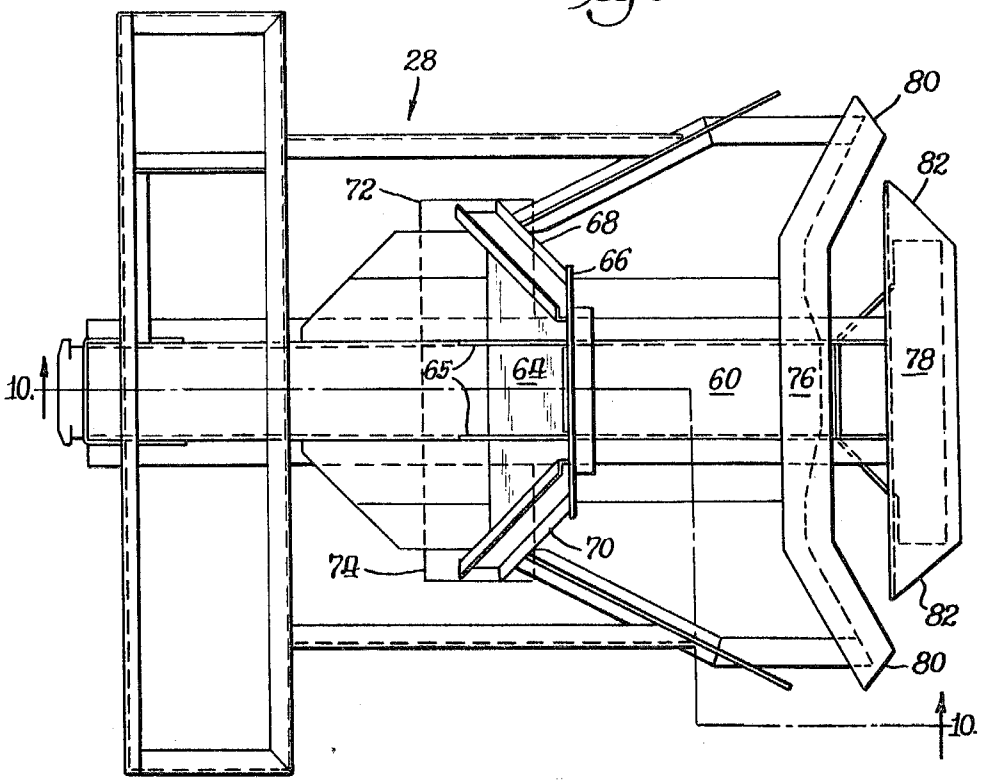
FIG. 9 is a plan view, partly in section, showing in greater detail the supporting structure of the railroad car shown in FIG. 1.
Figure 7:
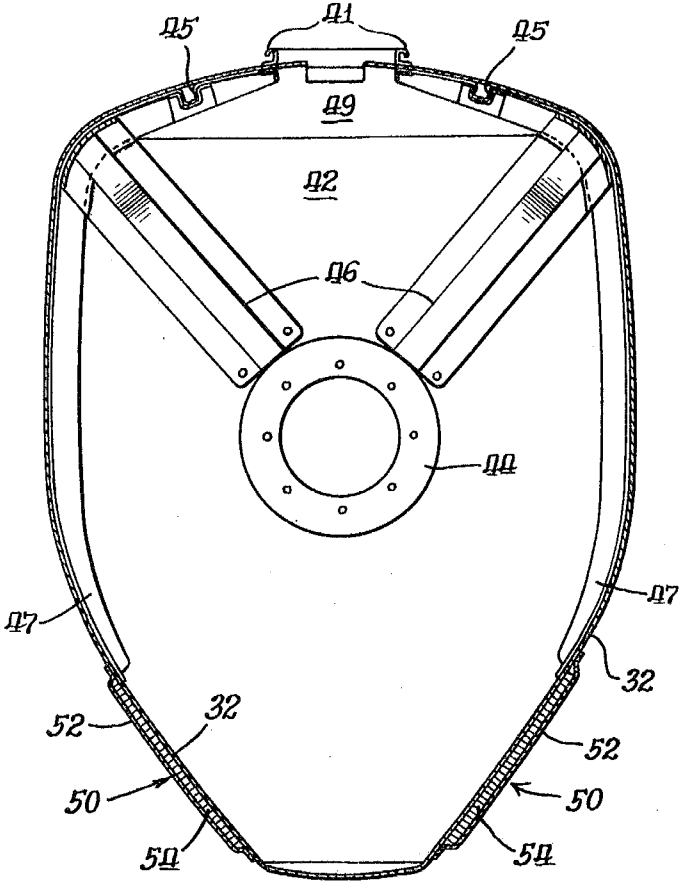

As shown particularly in FIG. 8, a plate 51 is fastened to each end of each beam column 50. The plate 51 is curved slightly to conform to the shape of the cross section of the beam column 50 and extends in the longitudinal direction in order that forces may be transmitted longitudinally into and out of the beam column 50. The plate 51 is preferably disposed midway between the longitudinal wall 32 and the longitudinal member 52. The plate 51 is spaced from each but adhesively coupled to each by adhesive members 55, which may be made of an epoxy resin. For providing an appropriate distribution of forces, a spacer 56 of soft material, such as formed polyurethane is disposed between the proximal end of the plate 51 and the spacer 54 and is shaped to provide a tapering of the adhesive members 55 in the direction of the spacer 54. The plate 51 is also secured to the longitudinal wall 32 and the longitudinal member 52 by bolts to assure a firm and lasting connection by which a supporting structure may be connected to the beam column 50 for the transmission of longitudinal forces.

The spacers 54 in the beam columns 50 may be about three inches thick, thus providing a relatively stable column for end loading, permitting the transmission of the forces required. The bulkheads 34 and slope sheets 36 extend across the car and stabilize the beam columns 50 by dividing them into short sections, leaving only relatively short unsupported buckling lengths, and hence providing increased strength against buckling. As these beam columns transmit most of the longitudinal load, the bending effect of the eccentric loading of the ends of the longitudinal walls 32 is reduced. At the same time, they save weight over having the walls 32 reinforced all the way around.

The supporting structures 28 may be identical and may be as shown in FIGS. 9, 10, 11, 12 and 13. Each supporting structure 28 includes a center sill 50 mounted on a center bearing plate 58 pivotally mounted on conventional center pin and center plate liner of a respective truck 14. Conventional draft rigging 62 may connect the coupler 30 to the center sill 60 and the center plate 58. A bolster structure 63 for supporting the car body is rigidly supported on the center sill 60. A central strut 64 of the end connection 63 extends substantially vertically from the center sill 60 at the bearing plate 58 to the truncation 44 of the end wall 42. The strut 64 is there connected to a connecting plate 66. A clamping ring 67 is connected to the connecting plate 66, as by bolts, to clamp the connecting plate 66 to the end wall 42 at the truncation 44. Side struts 68 and 70 extend upwardly from side beams 72 and 74 extending laterally outward from the center sill 60 at the center plate 58. These side struts 68 and 70 are fastened at their upper ends to the center strut 64. The beams 72 and 74 come in contact with conventional truck side bearings to support the car body 12 when tilted substantially out of vertical. The end connection 63 supplies a substantially vertical support for the car body 12 while applying but a relatively small force longitudinally to the car body. Because the lifting forces are applied at the ends of the end walls 42, rather than transversely of the end walls or the longitudinal walls 32, heavy reinforcement of the thin walls 32 is not needed.

An upper cross beam 76 and a lower cross beam 78 are rigidly affixed to the top and bottom respectively of the center sill 60. Each of the cross beams 76 and 78 is symmetrical about the centerline of the car. At each end 80 of the upper cross beam 76 and at each end 82 of the lower cross beam 78, the cross beams are rigidly affixed, as by welding, to respective corner posts 56. The cross beams 76 and 78 thus provide a yoke having four connections to the ends of the longitudinal walls 32 at balanced locations. The locations are balanced in the sense that force applied longitudinally at the couplers 30 is distributed among the four locations above and below and side-to-side in such a manner that relatively little torque is applied to the car body. More particularly, such locations are preferably symmetrical with respect to the centerline of the car and are approximately equidistant above and below the centerline of the couplers 30 so as to apply approximately one-fourth of the longitudinal forces at each location.

The illustrated car body, which is primarily comprised of the specified resin and glass filament composite, is thus relatively freely suspended at its two ends and is self-supporting therebetween. It meets the clearance requirements of AAR Plate "C-1" and has a total unloaded weight of about 44,000 pounds, compared to a conventional unloaded car of about 64,000 pounds. Of the 44,000 pounds, about 23,000 pounds is attributable to the car body and about 21,000 pounds is attributable to the truck-end assemblies. The car has a nominal capacity of 5,000 cubic feet and 218,000 pounds and is adapted to transmit the forces encountered in operation directly through the car body.

The railroad car 10 includes various other pieces of equipment as may be desirable or necessary. Such equipment, which may or may not be conventional, includes braking apparatus 84, a ladder 86 and a running board 88. A lifting eye 90 may be provided for raising an overturned car with a crane. The cross beams 76 may be used as pads for jacking up the car in the event of derailment. Additional aspects of car construction are shown in copending application entitled "Railroad Car", Ser. No. 851,154 now U.S. Pat. No. 4,230,048, heretofore executed and incorporated by reference herein.

Various modifications may be made in the railroad car within the scope of the present invention utilizing the specified resin-glass fiber composite matrix in a structurally, substantially self-supporting car body adapted to withstand and transmit applied forces inherent in the use of the car. Various materials and fastenings may be used. Other car body shapes may find particular application in various instances. Similarly, the supporting structure may take other forms providing vertical support for the ends of the car and longitudinal force in line with the couplers.

Various of the features of the invention are set forth in the following claims.

What is claimed is:

1. A railway hopper car comprising: an elongated load bearing railroad car body having sloping end walls at each longitudinal end thereof and substantially continuous longitudinal side and bottom walls intermediate said sloping end walls, said longitudinal side and bottom walls being substantially straight in a direction along the railroad car longitudinal axis to form a car body, said end walls and said longitudinal side and bottom walls being formed of a fiber-reinforced organopolymeric resin composite comprising from about 60 to about 75 weight percent of glass reinforcing filaments and from about 25 to about 40 weight percent of a structural polyester organopolymeric matrix resin, said matrix having a heat distortion temperature of at least about 90° C., a flexural strength of at least about 20,000 psi, a flexural modulus of at least about $5.0\times10^5$ psi, and a tensile elongation of at least about 3.0 percent, said glass reinforcing filaments of said resin composite of said car body being oriented in said car body at an angle such that said glass filaments and said matrix resin are capable of providing a composite comprising from about 70 to about 80 percent by weight of glass fibers and from about 20 to about 30 percent of said matrix resin and in the direction of winding having a tensile strength of at least about 100,000 psi, a flexural modulus of at least about $6\times10^6$ psi, an interlaminar shear strength of at least about 5,000 psi, an interlaminar shear strength after 24 hour water boil of at least about 5,000 psi, a flexural strength at room temperature of at least about 100,000 psi, a flexural fatigue strength for $1\times10^6$ completely reversed cycles of at least about 30,000 psi, and a density of from about 0.07 to about 0.08 pounds per cubic inch, a bearing strength of at least about 25,000 psi and a self-extinguishing flammability rating; coupling means at each end of the car for coupling the car to other cars; a truck at each end of the car body, and supporting means pivotably mounted on each of said trucks for supporting said car body at each respective sloping end wall thereof for transport on rails.

2. A railroad car in accordance with claim 1, wherein said car body further includes hoop windings of glass reinforcing filaments in a matrix of said resin.

3. A railroad car in accordance with claim 1, wherein said composite walls comprise in the range of from about 64 to about 67 percent by weight of said glass filaments, based on the weight of said composite.

* * * * *

UNITED STATES PATENT AND TRADEMARK OFFICE

CERTIFICATE OF CORRECTION

PATENT NO. : 4,292,898

DATED : October 6, 1981

INVENTOR(S) : Robert Gordon, Harry A. King, James V. Springrose, Robert W. Cuddihy It is certified that error appears in the above—identified patent and that said Letters Patent is hereby corrected as shown below:

In the References Cited, "3,495,548 2/1979 Rollins 105/358" should read ---3,495,548 2/1970 Rollins 105/358---.

In Other Publications, after "1961" and before "pp.", insert ---TA 455 P 55---.

In Column 5, line 64, "otherwide" should read ---otherwise---.

In Column 6, line 53, "slop" should read ---slope---.

In Column 7, line 2, "falling" should read ---filling---.

In Column 8, line 62, in the table, the second line reading "Compressive Strength ASTM D695-69" should have been deleted.

In Column 10, line 58, "an" should read ---as---.

In Column 11, line 51, "center sill 50" should read ---center sill 60---.

In Column 11, lines 66 and 67, "center plate 58" should read ---center bearing plate 58---.

In Column 13, line 23 (Claim 1), "20 to about 30 percent of said matrix" should read ---20 to about 30 percent by weight of said matrix---.

UNITED STATES PATENT AND TRADEMARK OFFICE

CERTIFICATE OF CORRECTION

PATENT NO. : 4,292,898

DATED : October 6, 1981

INVENTOR(S) : Robert Gordon, Harry A. King, James V. Springrose, Robert W. Cuddihy It is certified that error appears in the above—identified patent and that said Letters Patent is hereby corrected as shown below:

In Column 14, line 22 (Claim 3), "64 to about 67 percent" should read ---63 to about 67 percent---.

Signed and Sealed this

*Ninth* Day of *February 1982*

[SEAL]

*Attest:*

GERALD J. MOSSINGHOFF

*Attesting Officer* *Commissioner of Patents and Trademarks*